US006730884B2

(12) United States Patent
Baker et al.

(10) Patent No.: US 6,730,884 B2
(45) Date of Patent: May 4, 2004

(54) PROTECTIVE CIRCUIT FOR ELECTRICAL HEATING ELEMENT

(75) Inventors: Robert W. Baker, Westerville, OH (US); Stephen A. Mowrer, Westerville, OH (US)

(73) Assignee: Liebert Corporation, Columbus, OH (US)

( * ) Notice: Subject to any disclaimer, the term of this patent is extended or adjusted under 35 U.S.C. 154(b) by 0 days.

(21) Appl. No.: 10/288,236

(22) Filed: Nov. 5, 2002

(65) Prior Publication Data

US 2003/0121903 A1 Jul. 3, 2003

Related U.S. Application Data

(60) Provisional application No. 60/338,528, filed on Nov. 5, 2001.

(51) Int. Cl.[7] ..... H05B 1/02

(52) U.S. Cl. ..... 219/485; 219/481; 219/506; 392/465; 361/178

(58) Field of Search ..... 219/481, 490, 219/497, 501, 505, 494, 506; 352/466, 465, 485; 361/42, 178, 47–50

(56) References Cited

U.S. PATENT DOCUMENTS

| | | | | |
|---|---|---|---|---|
| 4,550,358 A | * | 10/1985 | Crowley et al. | 361/42 |
| 5,305,760 A | * | 4/1994 | McKown et al. | 128/692 |
| 6,218,647 B1 | * | 4/2001 | Jones | 219/501 |
| 6,246,831 B1 | * | 6/2001 | Seitz et al. | 219/483 |
| 6,590,188 B2 | * | 7/2003 | Cline et al. | 219/497 |
| 6,614,009 B2 | * | 9/2003 | Gershtein et al. | 219/486 |

* cited by examiner

*Primary Examiner*—Mark Paschall
(74) *Attorney, Agent, or Firm*—Howrey Simon Arnold & White LLP

(57) ABSTRACT

The present invention provides an electrical circuit that measures the ground current due to insulation leakage in electrical heating elements. The circuit uses a CT to measure the current being supplied to at least one of a plurality of electrical heating elements. Using a comparator circuit and noise rejection circuitry to prevent erroneous tripping, once the current reaches a predetermined threshold, a signal is sent to a switch that causes a non-volatile memory device to clear thereby de-energizing the coil of the contactor that provides power to at least one of the heating elements.

16 Claims, 1 Drawing Sheet

PROTECTIVE CIRCUIT FOR ELECTRICAL HEATING ELEMENT

This application claims priority to U.S. Provisional Application No. 60/338,528, filed Nov. 5, 2001 and having the same inventors and title as the present application.

FIELD OF THE INVENTION

The present invention relates generally to protection against ground leakage current in electrical heating elements.

BACKGROUND OF THE INVENTION

Environmental control air conditioning (A/C) systems for sensitive heat generating electronic equipment such as data processing, telecommunications, medical laboratories, industrial process control systems and network servers are used to maintain the desired temperature and humidity. Excess and insufficient humidity in rooms containing sensitive equipment can potentially harm the equipment. Excess moisture in the air can accelerate oxidation of electronic circuits, conductors and connectors and can provide high-resistance current paths that negatively affect equipment performance. Conversely, a lack of moisture increases the potential for equipment damage due to static electricity.

The ability of an A/C system to maintain both the desired temperature and humidity often requires the use of reheat systems. Frequently to remove the appropriate amount of moisture from a room, especially during the winter months, the resultant temperature from using the A/C system to control humidity is below the desired room temperature. Hence, reheat systems reheat the air being supplied to the room to maintain the desired temperature, while also assisting in the dehumidification process.

Electric heating elements typically used in air conditioning (A/C) reheat systems are metal-sheathed resistance-type heating elements composed of a metal outer sheath, resistive wire and insulation. The metal outer sheath is typically made of stainless steel material. The resistive wire can be made of a nickel-chromium material and is embedded in a magnesium oxide powder insulating material. The resistive wire is also connected to a pin connector or terminal. Power is supplied via the connector or terminal and causes the resistive wire to emit heat. The heat produced by the resistive wire is then transferred via the insulating material to the metal sheath. The air being supplied to the room is passed over the heating elements and, thus, reheated air is supplied to the room.

A variety of failures are common in metal-sheathed heating elements, such as deterioration of the metal sheath due to corrosion, moisture build-up during the summer months caused by condensation in the A/C system when the heating elements are not in use, excessive heat generated by the heating element caused by a inadequate insulation, moisture build-up in the insulation material resulting in interior corrosion of the metal sheath and bending of the heating elements, resulting in stress points and fractures. These failures frequently cause leakage of the heating element's insulation material on surrounding surfaces as a result of cracks or holes in the metal sheath.

In addition to the contamination of surrounding surfaces caused by the failure of the heating element, the current through the resistive wire is reduced because of current leakage to ground as a result of the degraded heating element insulating material. Excess current leakage can cause short circuits and ground faults. Typical electric reheat systems utilize overcurrent protective devices, such as circuit breakers to de-energize the heating element in the event of an overcurrent condition caused by the shorting of conductors or a ground fault. While this typically protects the equipment from extensive damage due to excessively large currents, it is desirable to de-energize the heating elements prior to the excessive current caused by shorted conductors or low impedance ground faults.

The present invention is directed to detecting ground current leakage in the heating elements and to prevent failure of the heating elements from advancing beyond an initial detectable stage.

SUMMARY OF THE INVENTION

To that end, it is an object of the present invention to provide a circuit that measures the ground current due to insulation leakage in an electric heating element and de-energize the heating elements if the ground current exceeds a predetermined normal amount. All of the current carrying conductors supplying power to the heating element (s) are passed through the core of a toroidal current transformer (CT). The output of the CT is coupled to an input of a comparator device. The comparator device has a predetermined value equivalent to the threshold ground current indicative of insulation leakage in at least one of the heating elements. If the ground current measured by the CT and transmitted to the comparator exceeds the predetermined value, an SCR is fired to de-energize the coil of the contactor coil supplying power to the heating elements.

To avoid erroneous de-energization of the heating element because of switching transient current spikes, noise rejection circuitry may be added. The noise rejection circuitry includes a weighted averaging circuit that uses a second comparator to average the ground current over several cycles. This circuit requires several cycles of ground current detection above the predetermined threshold value, prior to de-energizing the heating element(s).

Because the implications of prolonged ground current leakage above a nominal level in heating elements include the possibility of severe equipment damage, such as the A/C system that includes the heating elements, the need to permanently remove power from the heating elements can be appreciated. Therefore, another aspect of the invention, includes the use a non-volatile memory device, such as a fuse, to semi-permanently de-energize the heating elements. In this circuit feature, the output of the SCR is series-connected with a fuse and the contactor coil power supply. In operation, once the ground current detection circuit detects a ground current above a predetermined threshold, the SCR is activated, which allows a current in excess of the fuse rating to be supplied to the fuse, causing the fuse to clear thereby de-energizing the contactor coil and, thus, de-energizing the heating element(s).

In yet another aspect of the present invention, it also desired to both prevent the operation of the heating element (s) when the CT is not properly connected and to allow testing of the circuit without affecting the non-volatile memory device. This is accomplished by adding a jumper connection in series with the fuse. The jumper is terminated on the jumper terminals of the CT. If the CT is not connected, no power is supplied to the heating elements. If testing of the circuit is desired, the jumper can be replaced with a fuse having a value large enough to prevent the clearing of the fuse while also allowing enough current to energize the contactor coil.

In another aspect of the present invention, light emitting diodes (LED) are used to indicate the status of the circuit and the contactor. Further, an alarm output can also be connected to the normally closed contacts of the contactor to provide an alarm output and/or interface with a display, microprocessor control system or other auxiliary device. Lastly, another aspect of the invention may include a mechanism for continuous communication of the ground current value between the CT and the display, microprocessor control system or other auxiliary device.

Other objects and advantages of the invention will become apparent upon reading the following detailed description and upon reference to the drawings.

DETAILED DESCRIPTION OF THE DRAWING

Figure 1:
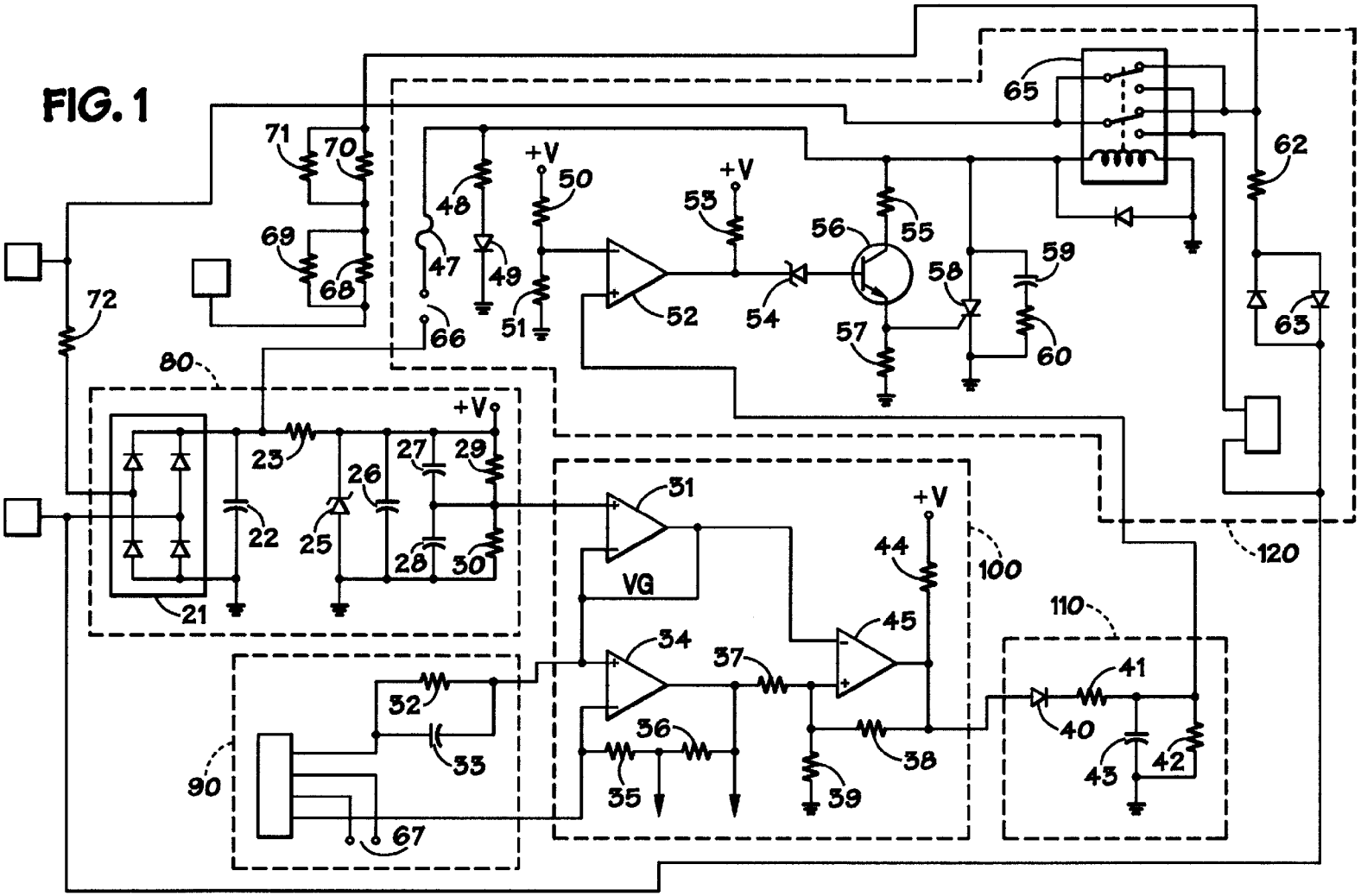
FIG. 1 is detailed electrical schematic diagram of a control circuit according to the present invention.

FIG. 1 illustrates an embodiment of a ground current detector according to the present invention. The circuit includes a power supply section 80, a current transformer (CT) interface section 90, a comparator section 100, a noise rejection section 110 and an output section 120.

The power supply section 80 comprises an inrush limiting resistor 72 connected to the common contact of relay 65, a bridge rectifier 21, a filter capacitor 22, a shunt regulator formed by resistor 23 and zener diode 25, a ripple reduction capacitor 26, voltage divider circuitry having a plurality of capacitors 27 and 28, and a plurality of resistors 29 and 30.

The rectifier 21 converts the AC input voltage to an output DC voltage that is filtered using filter capacitor 22 and regulated using resistor 23 and zener diode 25. The regulated voltage is then smoothed using the ripple reduction capacitor 26. The smoothed voltage is then divided using a voltage divider circuit, comprised of series-connected resistors 29 and 30 in parallel with capacitors 27 and 28, respectively.

The divided voltage provides a reference point and permits single supply operation of a plurality of operational amplifiers (OA) 31 and 34 in the comparator section 100 of the circuit. OA 31 and OA 34 operate in opposite phases and are connected to form a voltage comparator. The divided voltage of the power supply section 80 is the positive input signal to OA 31 and a feedback path constituting a virtual ground coupled to the output of OA 31 is connected to the negative input to OA 31. The negative input of OA 31 is also coupled to the positive input of OA 34 and the CT output connected through the parallel combination of resistor 32 and capacitor 33 of the CT interface section 90.

The CT (not shown) can be a typical toroidal CT having all of the current carrying conductors supplying power to the plurality of heating elements passing through the CT. The CT operates to provide, via its secondary side connection, a voltage signal equivalent to the amount of ground current flowing within the heating elements' conductors. Via the CT connector 73, the equivalent ground current voltage signal is an input to the negative input connection of OA 31 and the positive input connection of OA 34 in the comparator section 100 of the circuit through the series connection of resistor 32 and capacitor 33 connected in parallel. Capacitor 33 preferably has a large capacitance value, making the DC gain of OA 34 essentially zero while also operating to block the offset voltage of the OA 34. Resistor 32 is used to keep the capacitor 33 from charging excessively during the period when power is first applied to the circuit and the virtual ground is not properly established.

The AC component of the CT is connected to the summing junction of the negative input to OA 34. OA 34 output is driven to the voltage that causes an equal amplitude but opposite polarity current through a feedback resistor formed by the series connection of resistor 35 and resistor 36, such that the net current at the negative input to OA 34 is zero. During normal operation, for example, with 50 mA RMS in the CT primary, the CT secondary will have 0.5 mA RMS and the voltage at output of OA 34 will be 3 V RMS. The series connected feedback resistors 35 and 36 are to facilitate changes in the scale factor of the circuit, if necessary, by using a connection across resistor 36. For example, using the connection across resistor 36 to short resistor 36 changes the trip threshold of the circuit from 50 mA to 100 mA.

The output of OA 31 is also coupled to the negative input of OA 45. The output of OA 34 connected in series with resistor 37 is connected to the positive input of OA 45. The output of OA 45 provides a feedback coupled to the positive input of OA 45 through resistor 38. The positive input of OA 45 is also coupled to a resistor 39 connected to ground. The output voltage of OA 34 is attenuated and shifted using resistors 37 and 39 with significant hysteresis provided by resistor 38. High hysteresis is used to stretch the pulse at the output of OA 45, such that the pulse is long as possible without latching the comparator circuit section 100. Otherwise, a single noise pulse at the CT primary could possibly trip the detector.

The output of OA 45 is coupled to resistor 44 and to the noise rejection section 110 of the circuit. The noise rejection section 110 is comprised of a combined peak detector and integrating filter formed by the series connection of diode 40 and resistor 41 coupled to the parallel connection of capacitor 43 and resistor 42. This circuit adds a delay of up to 6 line cycles for rejection of noise to minimize the likelihood of nuisance tripping. The output of this noise rejection circuitry is applied to the positive input of a final comparator OA 52 in the output section 120.

The negative input to OA 52 is coupled to the circuit reference voltage connected in series with resistor 50 and resistor 51. The output of OA 52 is coupled to the cathode of zener diode 54 and the circuit reference voltage through resistor 53. The anode of zener diode 54 is connected to the base of switch 56. The collector of switch 56 is connected through resistor 55 to the power supply for the coil of relay 65. The emitter of switch 56 is coupled to resistor 57 and the gate of switch 58. The anode of switch 58 is coupled to the power supply for the coil of relay 65 and a filter circuit comprising the series connection of capacitor 59 and resistor 60 connected across switch 58 coupled to the cathode of switch 58 and ground.

A fuse 47 and jumper connection 66 is in series with the coil of relay 65. The purpose of the jumper connection 66 is to cause relay 65 to become inoperable when the CT is not connected to the circuit using the jumper terminations 67 located in the CT interface section 90. The jumper connection 66 and jumper termination 67 also permits testing of the circuit without the need to actually clear fuse 47. Testing of the circuit is performed by replacing the jumper termination 67 with a resistor. The resistor should be of a value that appreciably reduces the current to below fuse 47 rating while also allowing enough current to energize relay 65.

During circuit operation, when a current above a predetermined threshold is reached, the output of OA 52 goes high and causes a detector trip. Tripping of the detector is accomplished by a current flowing through resistor 55 through zener diode 54 into the base of switch 56. Switch 56 then turns on and draws current through resistor 55, which is delivered to the gate of switch 58. When switch 58 turns on, the output of fuse 47 is shorted, cleaning fuse 47 and de-energizing relay 65, thereby causing the relay's normally open contacts to de-energize the reheat elements.

The circuit also includes options to use of LEDs to indicate the status of the circuit and an option to use a normally closed contact of relay 65 to provide an alarm that the circuit is in the inoperative condition. The fused power supply to relay 65 is also coupled to resistor 48, which is connected in series to the anode of a preferably green LED 49. If the circuit is operational and power is being supplied to relay 65, the green LED is illuminated indicating an "OK" status of the circuit. If the relay is not energized, a resistor 62 connected in series with the normally closed contacts of relay 65 and an LED 63 are used to indicate a fault condition.

Another option in the circuit includes using a group of resistors comprised of parallel resistors 68 and 69 in series with parallel resistors 70 and 71 to prevent any damage to the circuit in the event the power is connected to the wrong terminals of the circuit.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope for the claimed invention, which is set forth in the following claims.

What is claimed is:

1. A protective device for an electrical heating element comprising:

a current transformer connected to detect current through all current carrying conductors of the heating element and having an output signal indicative of the sum;

a comparator circuit configured to compare the output signal to a predetermined threshold value and provide an output signal;

a control circuit operatively connected to the output signal of the comparator, the control circuit capable of de-energizing the heating element and;

a noise rejection circuit connected between the comparator circuit and the control circuit, the noise rejection circuit including a peak detector and an integrating filter configured to add a signal delay for preventing the control circuit from de-energizing the heating element in response to noise.

2. The protective device of claim 1 wherein the current transformer is a toroidal current transformer.

3. The protective device of claim 1 wherein the noise rejection circuit includes a series connected diode and resistor connected in series with a parallel connected capacitor and resistor.

4. The protective device of claim 1 further comprising a nonvolatile memory device to semi-permanently de-energize the heating element.

5. The protective device of claim 4 wherein the nonvolatile memory device is a fuse.

6. The protective device of claim 4 further comprising a resistor connected in series with the nonvolatile memory device to provide testing capabilities, wherein the testing of the circuit does not cause damage to the nonvolatile memory device.

7. The protective device of claim 6 wherein the resistor is a fuse.

8. The protective device of claim 1 further comprising an output signal indicative of the operational status of the control circuit providing power to the heating element.

9. The protective device of claim 8 wherein the output signal is a light emitting diode (LED).

10. The protective device of claim 8, wherein the output signal indicative of the operational status of the control circuit is coupled to an external device.

11. The protective device of claim 8, wherein the output signal indicative of the operational status of the control circuit is an input signal to a microprocessor system.

12. The protective device of claim 1, further comprising a plurality of output signals indicative of the current flowing through the heating element's current carrying conductors, wherein at least one of the plurality of output signals is an input to a microprocessor system.

13. The protective device of claim 1 wherein the noise rejection circuit includes a series connected diode and resistor connected in series with a parallel connected capacitor and resistor.

14. The protective device of claim 1 wherein the control circuit includes a fuse connected to a switch operating in response to the comparator circuit output signal, such that the switch turns on in response to the output signal of the current transformer exceeding the predetermined threshold value, thereby causing the fuse to open and de-energize the heating element.

15. A protective device for an electrical heating element comprising:

a toroidal current transformer connected to detect current through all current carrying conductors of the heating element and having an output signal indicative of the sum;

a comparator circuit configured to compare the output signal to a predetermined threshold value; and a control circuit operatively connected to the output signal of the comparator, the control circuit capable of de-energizing the heating element;

a noise rejection circuit connected between the comparator circuit and the control circuit, the noise rejection circuit including a peak detector and an intergrating filter configured to add a signal delay for preventing the control circuit from de-energizing the heating element in response to noise;

a nonvolatile memory device to semi-permanently de-energize the heating element;

a resistor connected in series with the nonvolatile memory device to provide testing capabilities, wherein the testing of the circuit does not cause damage to the nonvolatile memory device;

an output signal indicative of the operational status of the control circuit providing power to the heating element is an input signal to a microprocessor system; and a plurality of output signals indicative of the current flowing through the heating element's current carrying conductors, wherein at least one of the plurality of output signals is an input to a microprocessor system.

16. The protective device of claim 15 wherein the nonvolatile memory device comprises a fuse, the fuse being connected to a switch operating in response to the comparator circuit, such that the switch turns on in response to the output signal of the current transformer exceeding the predetermined threshold value, thereby causing the fuse to open and de-energize the heating element.

* * * * *